US011441533B2

(12) United States Patent
Gracia Lopez

(10) Patent No.: US 11,441,533 B2
(45) Date of Patent: Sep. 13, 2022

(54) POWER GENERATION BY CONTINUOUS FLOATATION

(71) Applicant: Fernando Gracia Lopez, Garza Garcia (MX)

(72) Inventor: Fernando Gracia Lopez, Garza Garcia (MX)

( * ) Notice: Subject to any disclaimer, the term of this patent is extended or adjusted under 35 U.S.C. 154(b) by 0 days.

(21) Appl. No.: 16/643,842

(22) PCT Filed: Oct. 30, 2018

(86) PCT No.: PCT/IB2018/001362
§ 371 (c)(1),
(2) Date: Mar. 2, 2020

(87) PCT Pub. No.: WO2019/043460
PCT Pub. Date: Mar. 7, 2019

(65) Prior Publication Data

US 2021/0062780 A1 Mar. 4, 2021

(51) Int. Cl.
*F03B 17/04* (2006.01)

(52) U.S. Cl.
CPC ..... *F03B 17/04* (2013.01)

(58) Field of Classification Search
CPC ..... F03B 17/02; F03B 17/025; F03B 17/04
See application file for complete search history.

(56) References Cited

U.S. PATENT DOCUMENTS 6,447,243 B1 * 9/2002 Kittle ..... F03B 17/02 415/92
2011/0156407 A1 * 6/2011 Dorozenski ..... F03B 17/02 290/1 R
2014/0197642 A1 * 7/2014 Daya ..... F03B 17/04 290/1 D

FOREIGN PATENT DOCUMENTS

CN 109083804 A * 12/2018
DE 102013008859 A1 * 11/2014 ..... F03B 17/02
ES 2005351 A6 * 3/1989

OTHER PUBLICATIONS

Naylor D. A Perpetual-Motion Machine Problem for Teaching Fluid Mechanics and Thermodynamics. International Journal of Mechanical Engineering Education. 2009;37(3):187-196. (Year: 2009).*
Simanek D. The Museum of Unworkable Devices. Accessible on Mar. 9, 2016 via the WayBack Machine. URL: https://web.archive.org/web/20160309010209/http://www.lhup.edu/~dsimanek/museum/themes/buoyant.htm and http://www.lhup.edu/~dsimanek/museum/unwork.htm (Year: 2016).*

* cited by examiner

*Primary Examiner* — Laert Dounis
(74) *Attorney, Agent, or Firm* — Jackson Walker LLP

(57) ABSTRACT

Power generation systems may be achieved by a variety of system, processes, and techniques. In one implementation, a power generation system may include a tank adapted to hold a liquid and a drive section submersed in the tank. The drive section may include a continuous, collapsible pressure container and a rotatable assembly around which the pressure container is routed. The rotatable assembly may contain an axis mounted to the tank. The drive section may also include a series of panels guided around the rotatable assembly to encourage the pressure container to expand and collapse as it circulates around the rotatable assembly.

16 Claims, 18 Drawing Sheets

POWER GENERATION BY CONTINUOUS FLOATATION

RELATED APPLICATIONS

This application claims priority to U.S. Patent Application No. 62/552,255, filed Aug. 30, 2017. This prior application is herein incorporated by reference in its entirety.

BACKGROUND

As the world continues to become more socially and economically advanced, its need for energy will continue to grow. Additionally, as the world's population continues to increase, its energy needs will grow. Thus, the need for energy will continue to expand.

Many traditional techniques for producing energy (e.g., combusting coal or natural gas) have become increasingly expensive with increased energy demand. Also, these techniques, as well as alternative techniques (e.g., nuclear), have numerous environmental drawbacks. Other traditional techniques (e.g., geo-thermal and hydro-electric) have not been able to keep pace with demand.

SUMMARY

In one general aspect, the invention is directed to a power generation system that is driven by the kinetic force of a rotating body that generates flotation air when it is immersed, with approximately half being inflated with a suitable gas for the purpose (e.g., air, nitrogen, helium, etc.) while approximately the other half is collapsed (the ratio is variable). Since the power generation system is mounted on one or more cylinders vertically aligned and freely rotating on horizontal axes, the buoyancy force makes the inflated portion of the motor tend to move, rotating a driveshaft.

In one implementation, a power generation system may include a tank and a drive section. The tank is adapted to hold a liquid (e.g., water), and the drive section is submersed in the tank. The drive section may include a continuous, collapsible pressure container and a rotatable assembly around which the pressure container is routed, the rotatable assembly containing an axis mounted to the tank. The driver section may also include a series of panels guided around the rotatable assembly to encourage the pressure container to expand and collapse as it circulates around the rotatable assembly.

In certain implementation, the system may include a second rotatable assembly around which the pressure container is also routed, the second rotatable assembly including an axis mounted to the tank. The first rotatable assembly and the second rotatable assembly may be vertically aligned with each other and horizontally aligned.

In particular implementations, the axis of the second rotatable assembly contains an inertia wheel for starting the motor.

The system may further include a panel between the rotatable assemblies along which the inner periphery of the pressure container may slide.

In certain implementations, the panels are mounted inside the pressure container. The panels may include one set of panels mounted on the inside of an inner periphery of pressure container and a second set of panels mounted on the inside of an outer periphery of the pressure container. The inner and outer panels may be paired, and the panels in each pair are connected to each other by a guide assembly. The system may also include a cam assembly to collapse the guide assemblies.

In some implementations, the panels are mounted to the outside of the pressure container. The system may further include a track to guide the panels around the rotatable assembly.

Particular implementations may include a locking assembly configured to lock an outer portion of the pressure container to an inner portion of the pressure container when the pressure container is collapsed.

In another implementation, a power generation system may include an elongated tank adapted to hold a liquid, a first rotatable assembly mounted horizontally in the tank, and a second rotatable assembly mounted horizontally in the tank. The second rotatable assembly may be spaced apart vertically from the first rotatable assembly. The system may also include an elongated, inflatable/collapsible, continuous pressure container routed around the rotatable assemblies. The system may further include a series of panels mounted to the inside of an outer portion of the pressure container, the panels urging the expansion and collapse of the pressure container as it circulates around the rotatable assemblies.

In some implementations, the system may include a series of panels mounted to the inside of an inner portion of the pressure container, the inner panels and the outer panels being pair, and a guide assembly between each pair of inner panel and outer panels.

Particular implementations may include a locking assembly configured to lock an outer portion of the pressure container to an inner portion of the pressure container when the pressure container is collapsed.

In an additional implementation, a power generation system may include a tank adapted to hold a liquid, a divider separating the tank into a first portion and a second portion, and a chamber mounted around a rotational axis such that one portion of the chamber is located in the first tank portion and a second portion of the chamber is located in the second tank portion. The system may also include a gas injection system adapted to inject gas into the first portion of the tank, the divider adapted to substantially prevent the gas from passing to the second tank portion. The liquid in the first portion may thereby be made less dense than the liquid in the second portion, causing the chamber to rotate.

DRAWING DESCRIPTION

Figure 1:
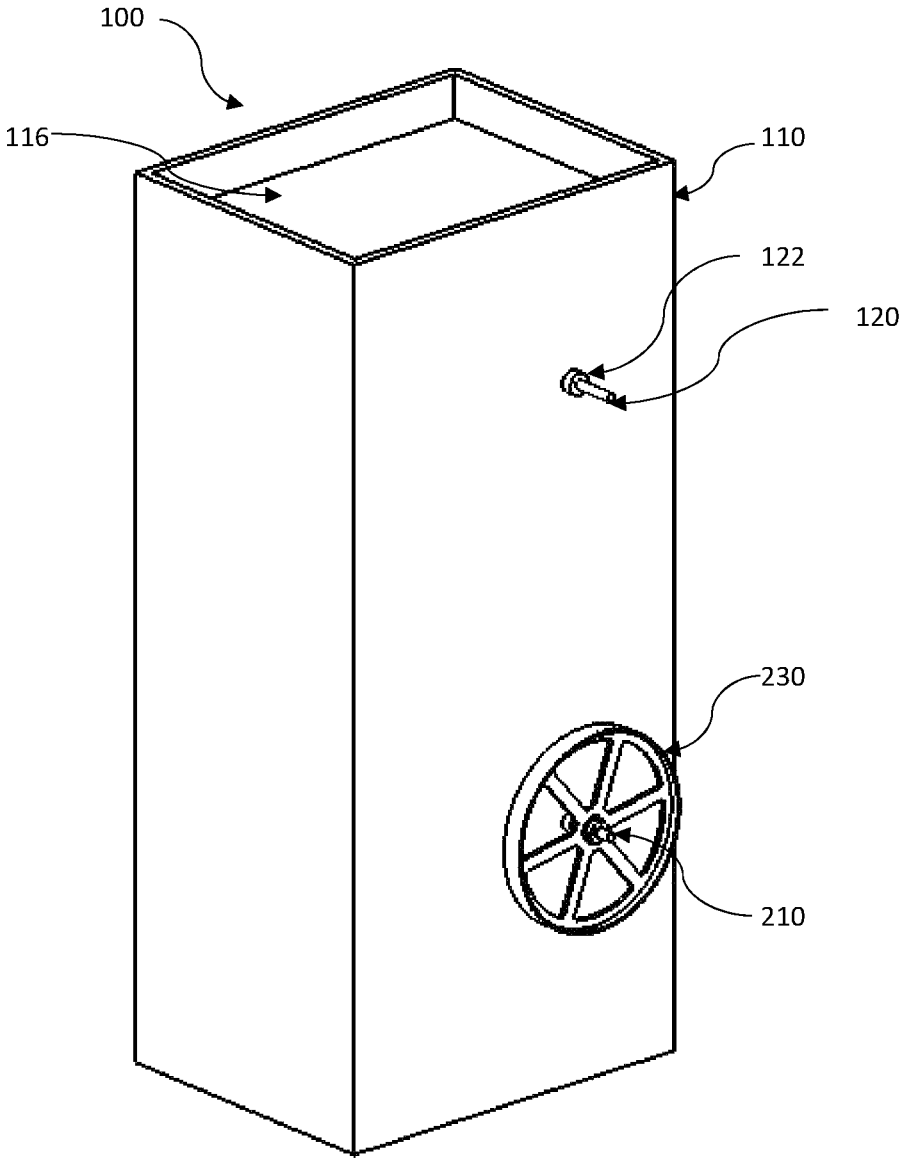
FIG. 1 is a perspective view illustrating an example motor in accordance with one implementation of the present invention.
Figure 5A:
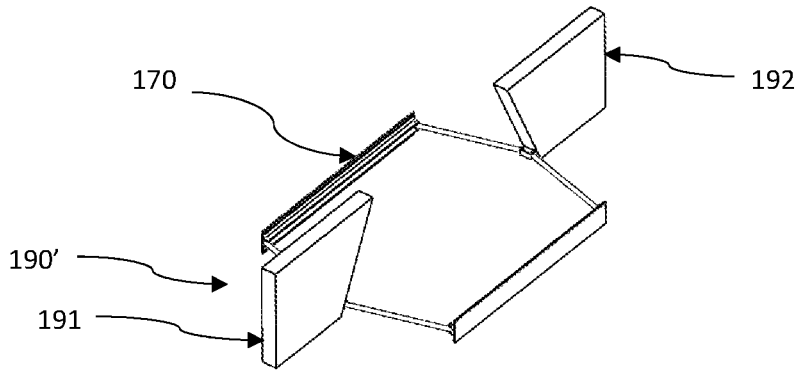
Figure 5B:
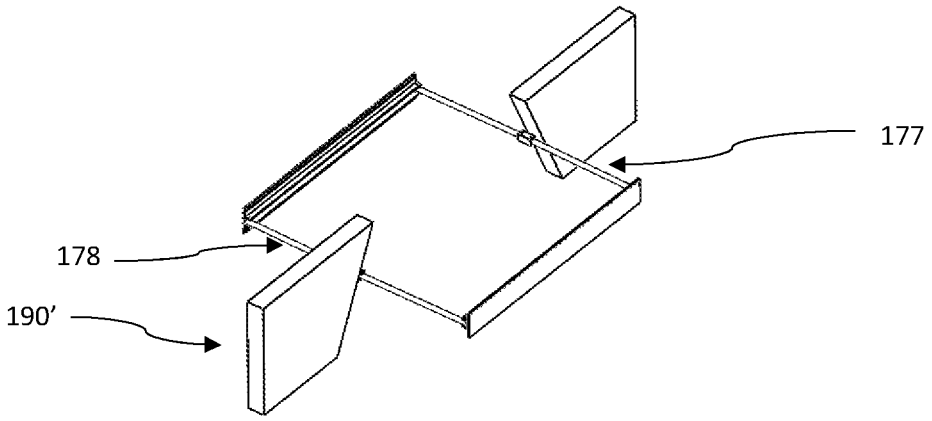
Figure 5C:
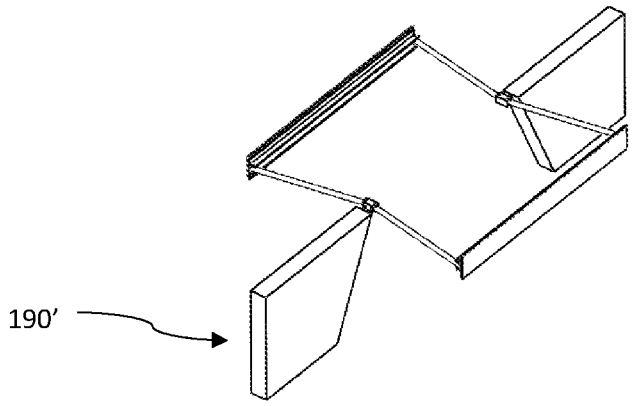

FIGS. 5A-C is a series of views showing the action of an example cam assembly for the example motor in FIG. 1.

Figure 6:
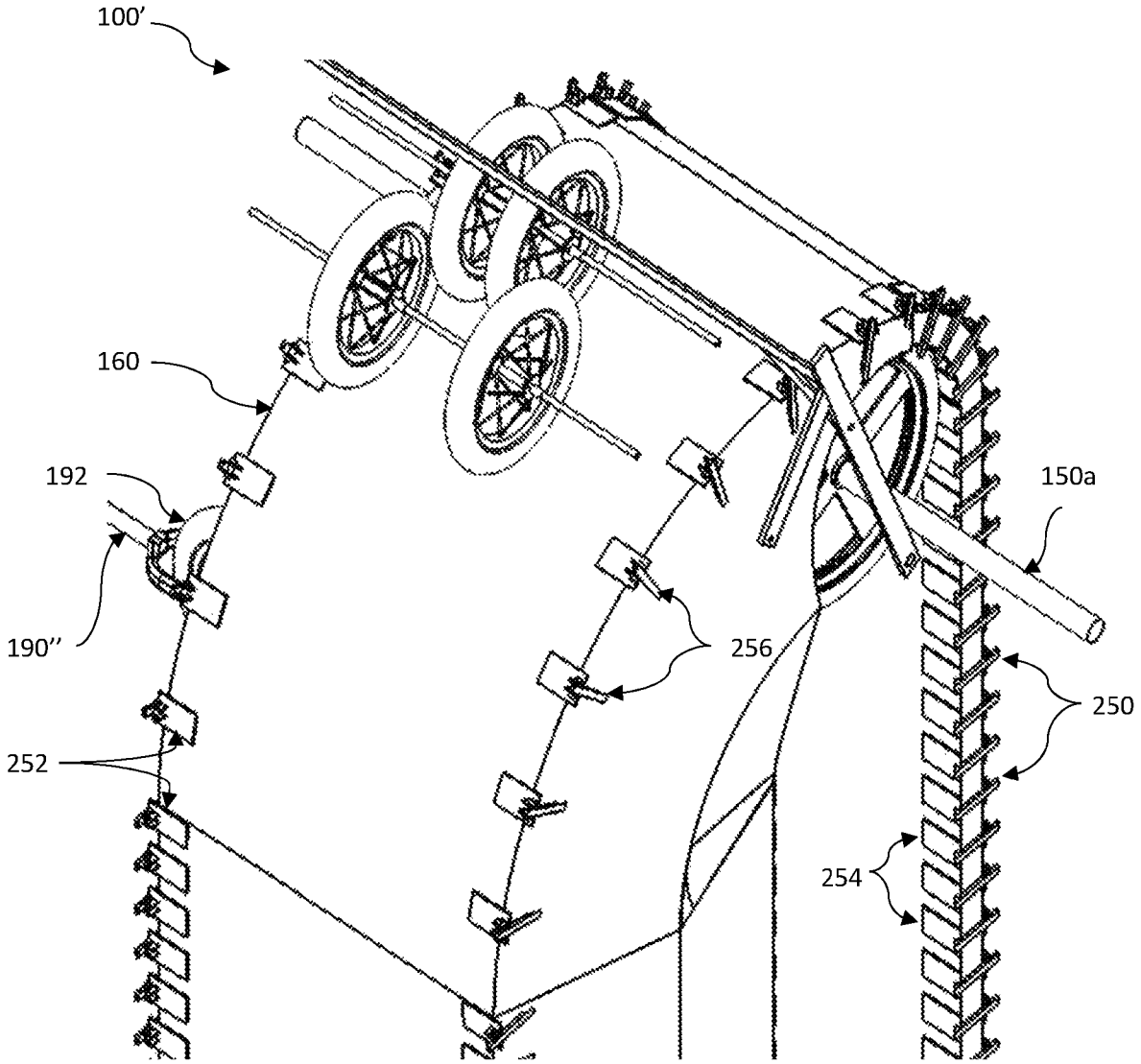

FIG. 6 is a perspective view of an alternate implementation of the motor in FIG. 1.

Figure 7:
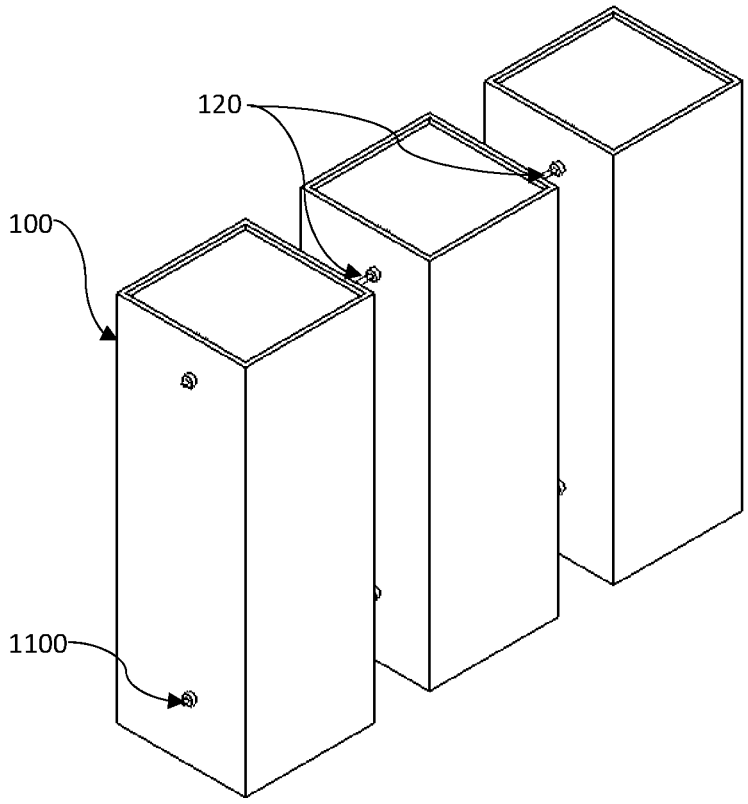

FIG. 7 is a perspective view illustrating a number of motors similar to that in FIG. 1 coupled together in series.

Figure 8:
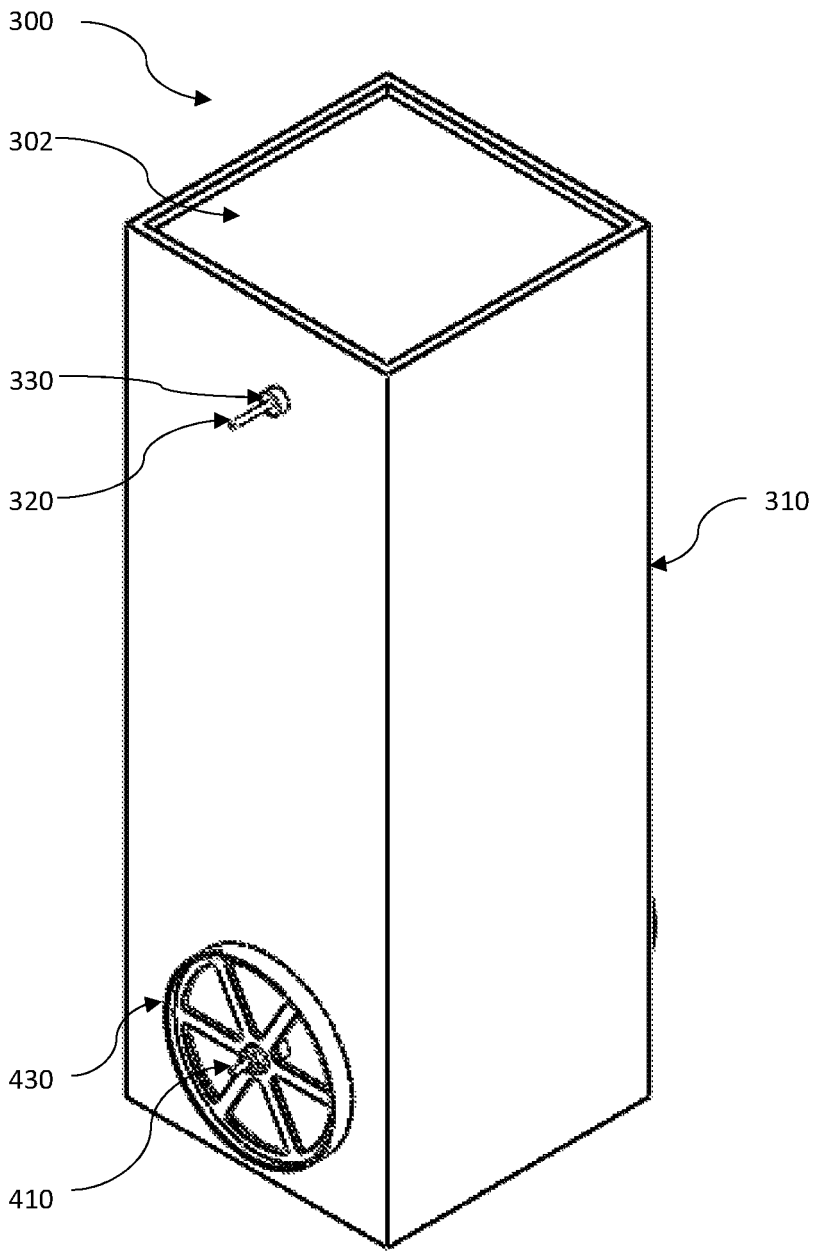

FIG. 8 is a perspective view illustrating another example motor in accordance with one implementation of the present invention.

Figure 9:
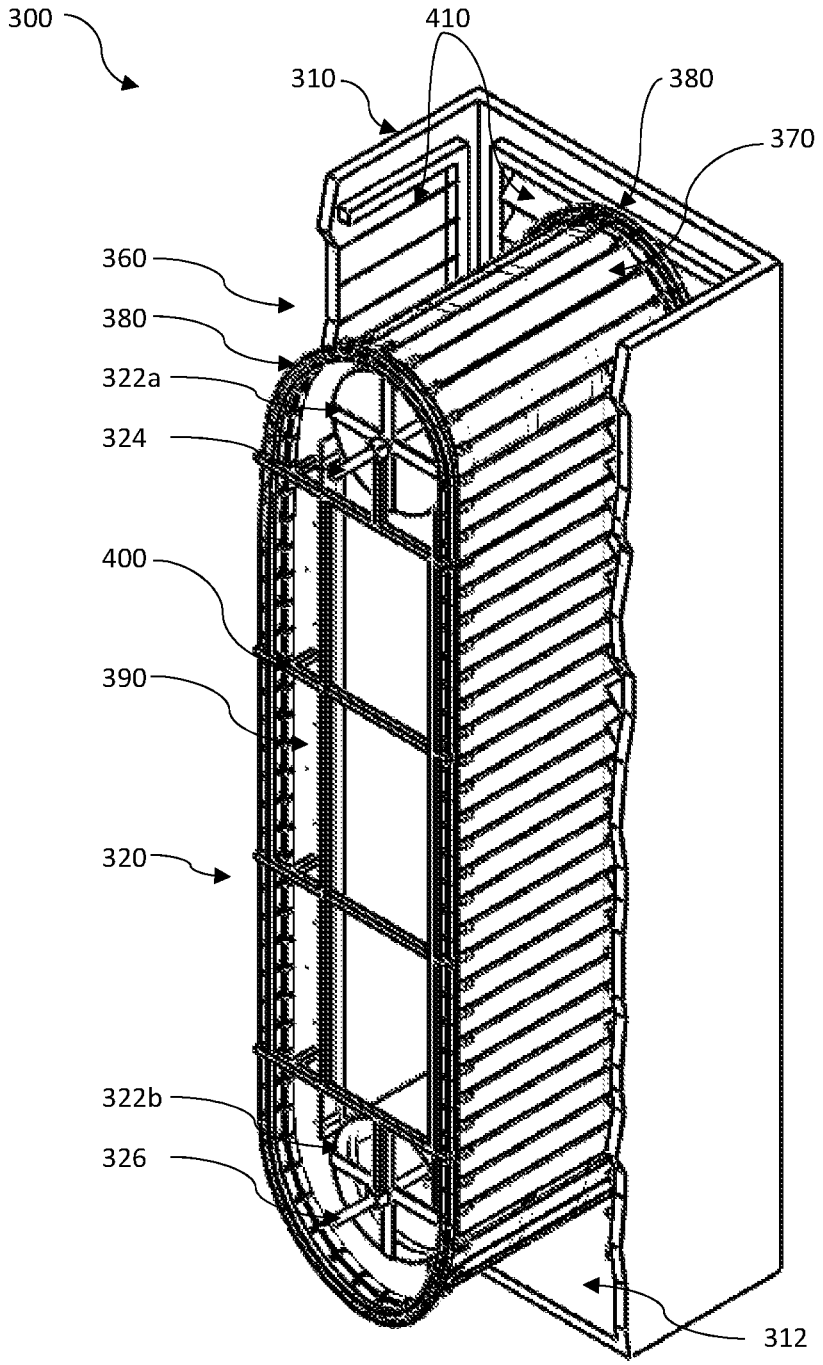

FIG. 9 is a cut-away perspective view illustrating of the example motor in FIG. 8.

Figure 10:
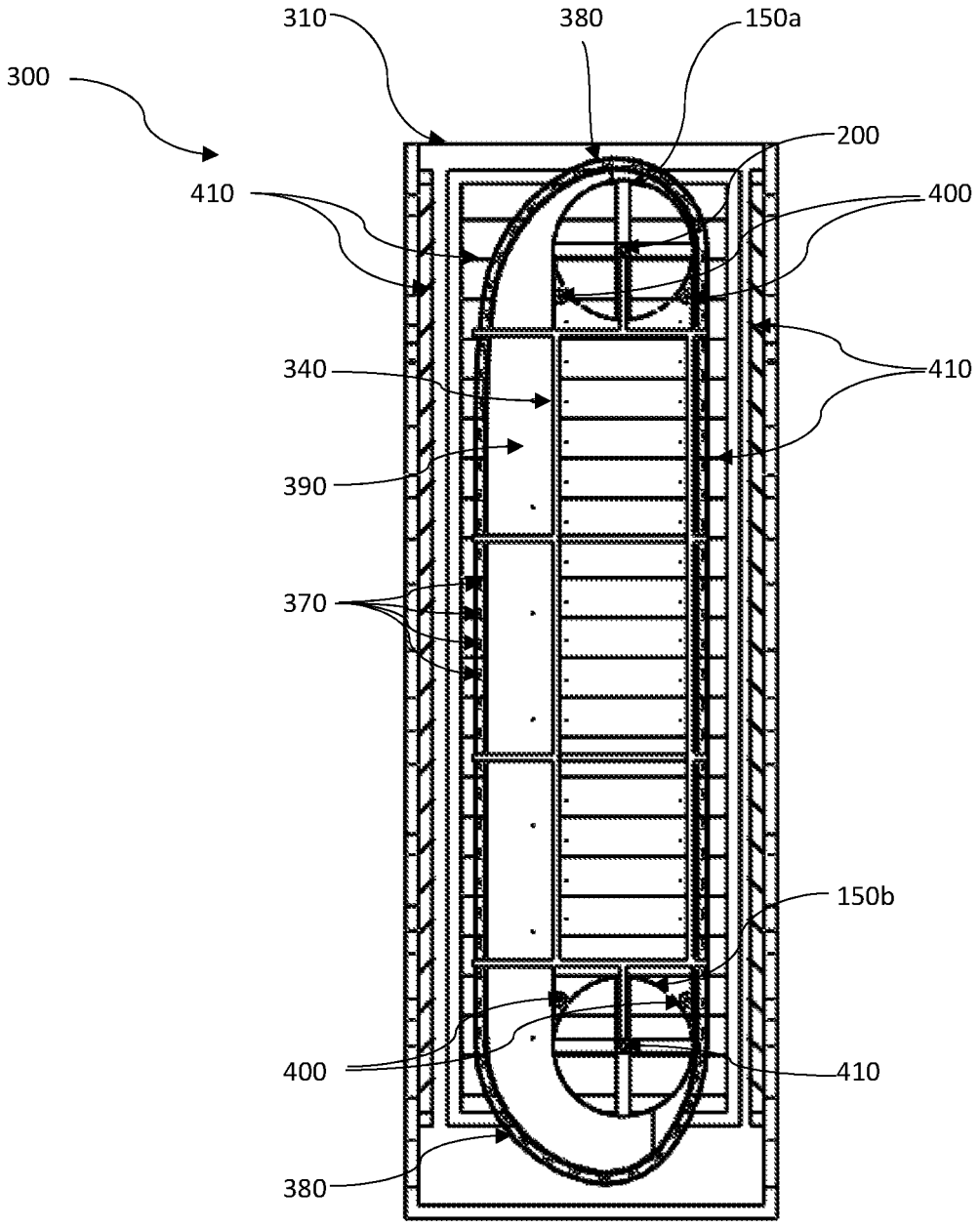

FIG. 10 is a cut-away side view of the example motor in FIG. 8.

Figure 11:
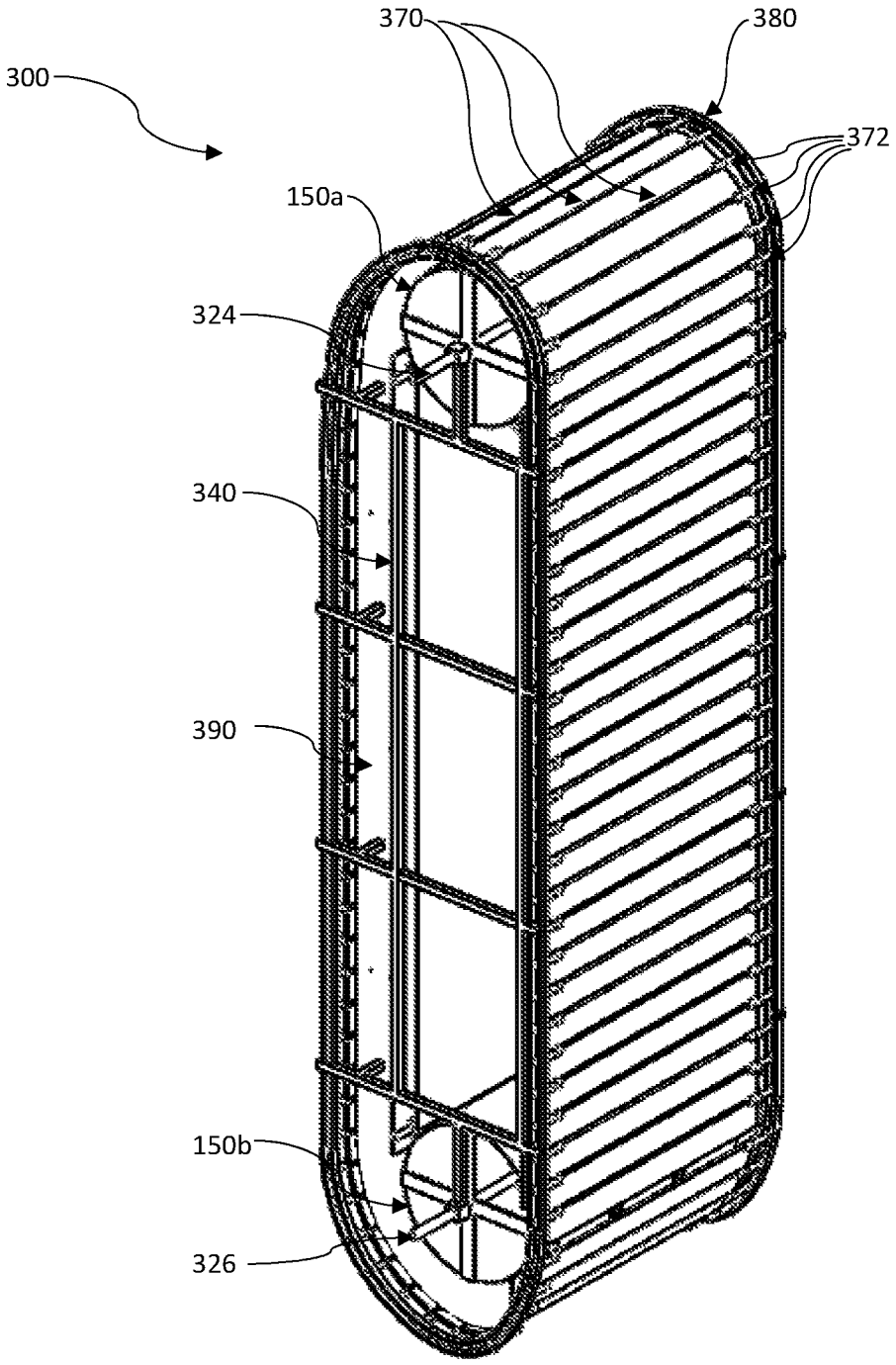

FIG. 11 is a perspective view of the example motor in FIG. 8 with the housing removed.

Figure 12:
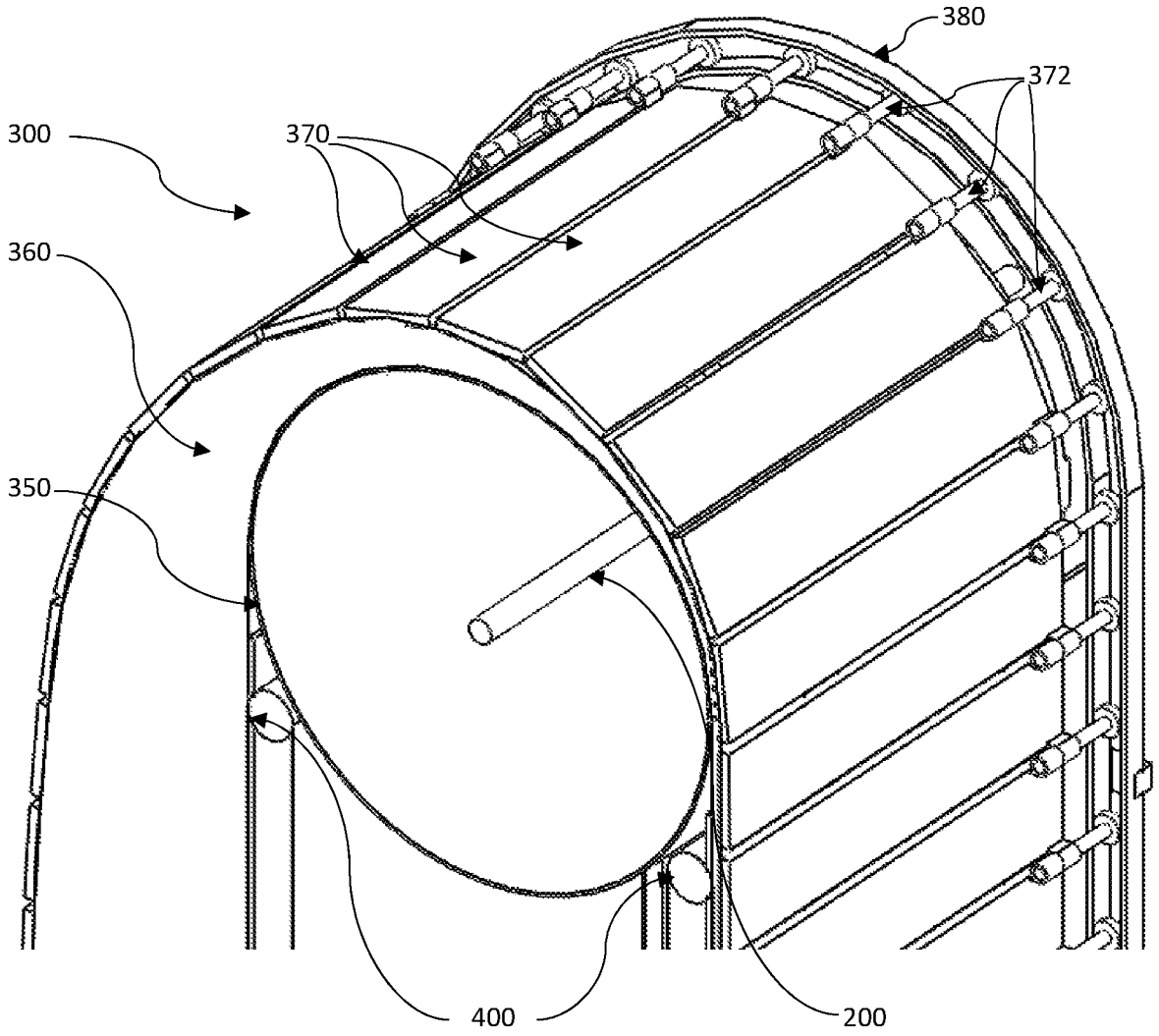

FIG. 12 is a detailed perspective view of the upper end of the example motor in FIG. 8 with the housing removed.

Figure 13:
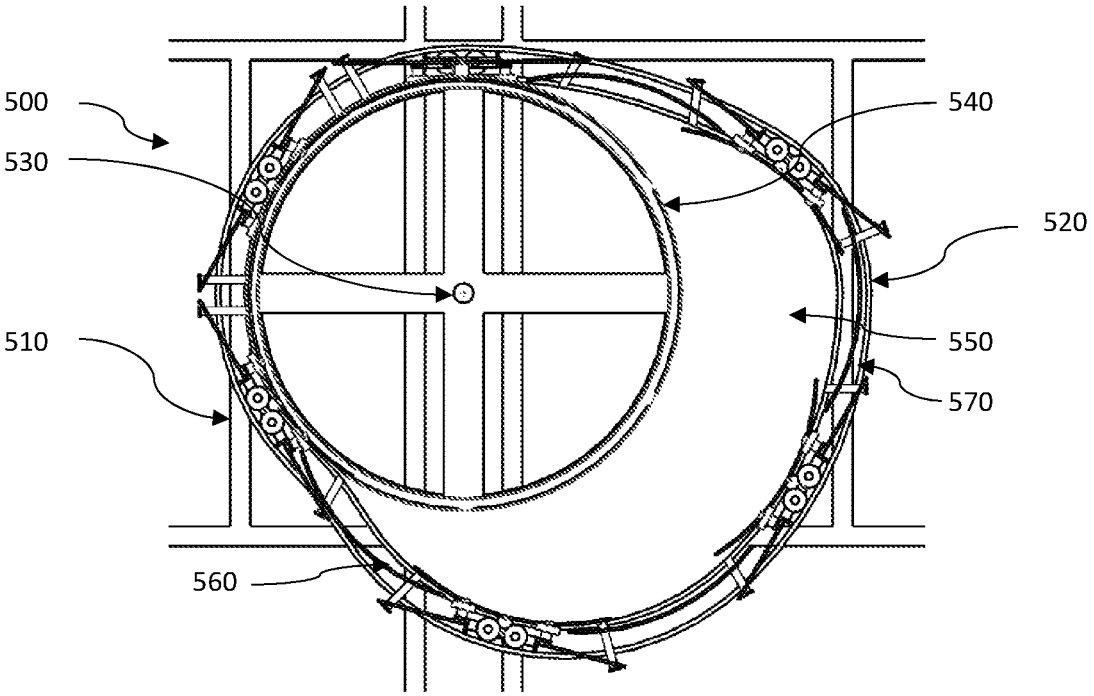

FIG. 13 is cut-away side view of an additional example motor in accordance with another implementation of the invention.

Figure 14:
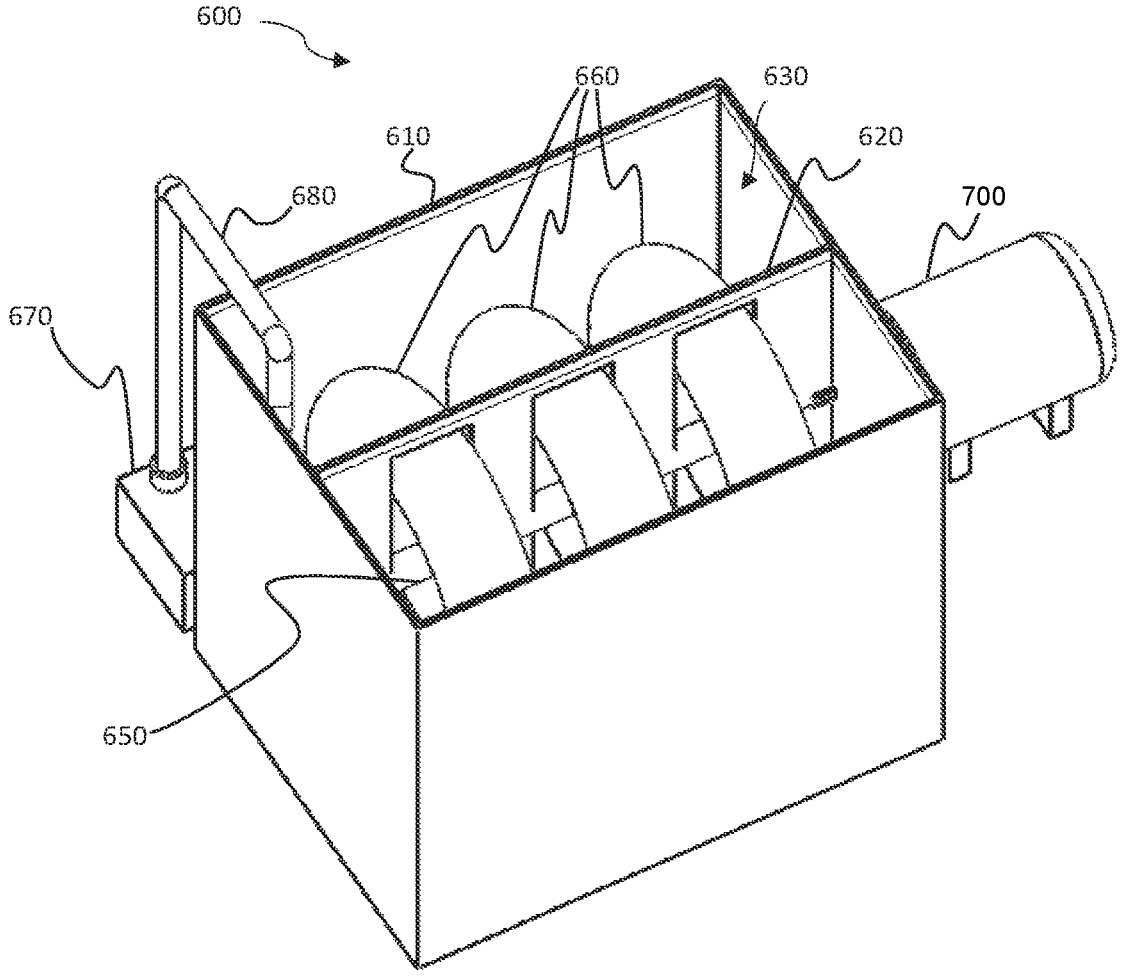

FIG. 14 is a perspective view illustrating an additional example motor in accordance with the present invention.

Figure 15:
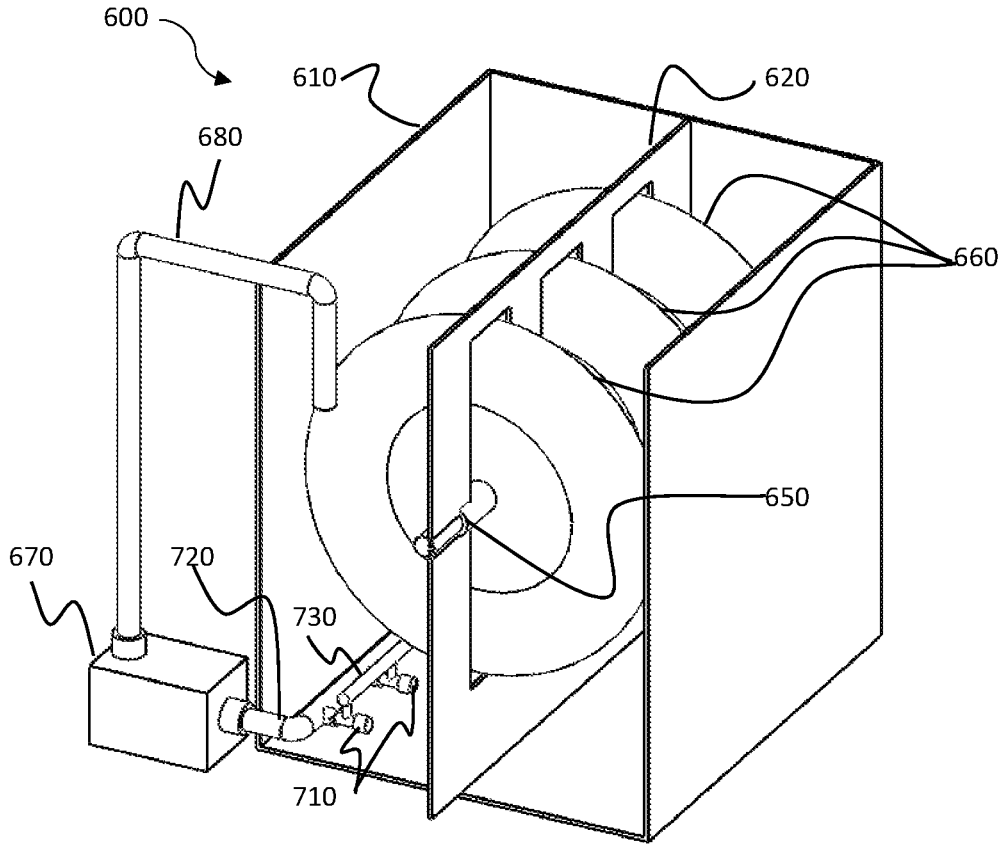

FIG. 15 is a cut-away view illustrating the example motor in FIG. 13.

Figure 16:
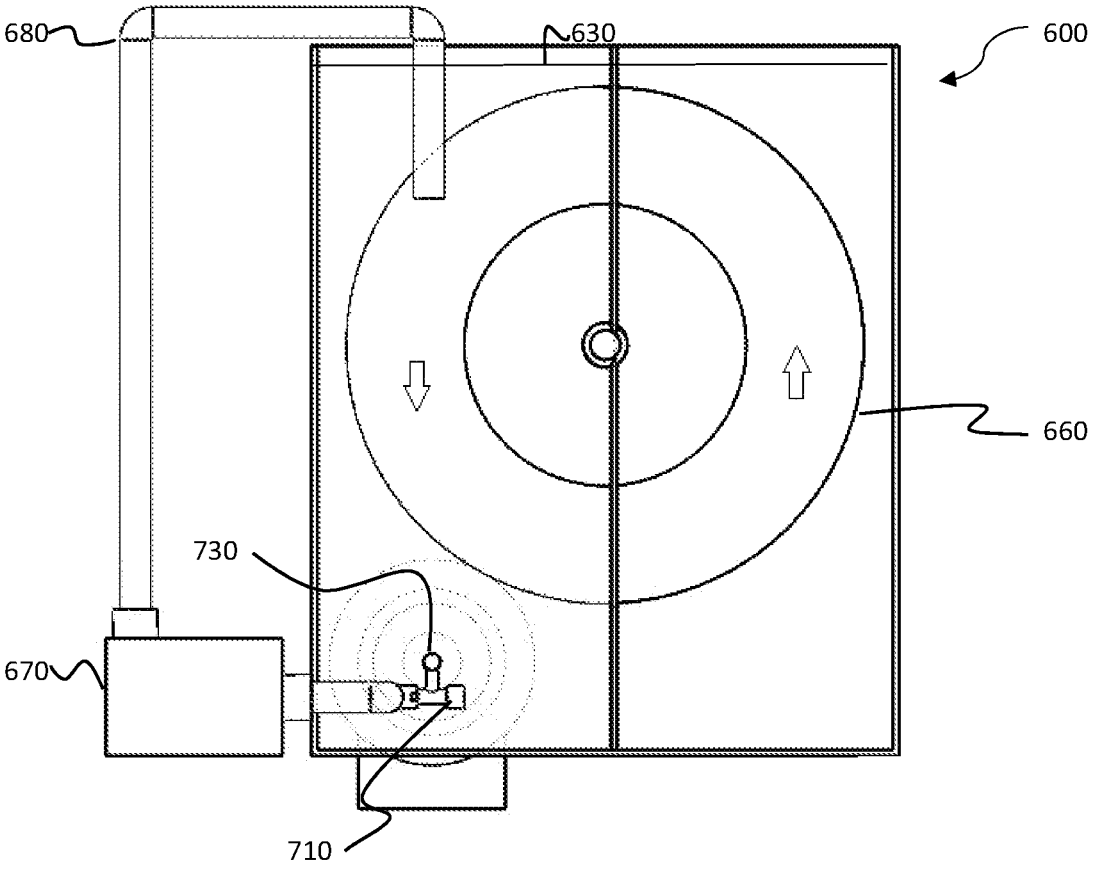

FIG. 16 is a cut-away side view illustrating the example motor in FIG. 13.

DETAILED DESCRIPTION

The present invention relates to a kinetic energy engine, that is, a motor capable of producing force and/or energy from the kinetic energy of moving bodies, for which a hollow body will be used. The hollow body may be collapsible/expandable or solid. By altering the buoyancy of the body, kinetic energy may be obtained, which may be converted into mechanical work or electricity.

FIGS. 1-5 illustrate an example motor 100 in accordance with one implementation of the present invention. Among other things, motor 100 includes a tank 110 inside which of which is mounted rotatable assemblies 150 and a collapsible/expandable pressure container 160.

Tank 110 is generally elongated and has a bottom 112, one of more sides 114, and a top 116. Although shows as being square in cross section, tank 110 may be rectangular, circular, oval, or other appropriate shape in other implementations. Tank 110 may be made of metal, concrete, plastic, or any other appropriate material. Bottom 112 and sides 114 forms a chamber 118 that is filled with a liquid, typically water. The liquid typically covers the pressure container 160 and may fill the chamber 118 in particular implementations. In certain implementations, water in the chamber may include antioxidants and lubricity additives which facilitate proper operation.

Each rotatable assembly 150 typically includes at least two wheels 152 (only one of which is viewable) that are connected by an axel 154. Extending from rotatable assembly 150*a* is drive shaft 120, which extends through at least one side wall 114 of tank 110. Drive shaft 120 is mounted in a bushing/bearing 122 so it, and, hence, rotatable assembly 150*a,* may turn freely. Extending from rotatable assembly 150*b* is drive shaft 210, which extends through at least one side wall 114 of tank 110. Drive shaft 210 is mounted so it, and, hence, rotatable assembly 150*b*, may turn freely.

As noted above, chamber 118 will typically be filled at least to the point at which pressure container 160 is submerged in liquid. As illustrated, pressure container 160 is a flexible, continuous loop that has a hollow cavity inside, roughly rectangular in cross section in this implementation. Pressure container 160 is routed around rotatable assemblies 150 so that it may circulate therearound.

At any particular time, part of pressure container 160 is fully expanded, and part of pressure container 160 is fully collapsed. In the illustrated implementation, about 35% of pressure container 160 is expanded, about 15% of the pressure container is collapsing, about 35% of the pressure container is collapsed, and about 15% of the pressure container is expanding. Different ratios of expanded/collapsing/collapsed/expanding may be achieved in different implementations. Which portions of pressure container 160 are expanded, collapsing, collapsed, and expanding will change as the pressure container circulates around rotatable assemblies 150. Typically, the volume that is being lost due to collapse is approximately equal to the volume that is being gained by expansion.

Pressure container 160 is partially (e.g., about 50%) filled with a fluid, which may be more buoyant than the liquid in chamber 118, In particular implementations, pressure container 160 may be partially filled with air (e.g., at ambient pressure). Of the fluid in pressure container 160, the vast majority (e.g., >95%) will be in the expanded portion versus the collapsed portion. Pressure container 160 may be made of rubber (e.g., cholorsulfonated polyethylene), canvas, plastic (e.g., polyvinyl chloride or urethane), or any other appropriate waterproof material.

Motor 100 also includes a number of press assemblies 170 configured to expand and collapse pressure container 160. Each press assembly 170 includes a panel 172 that is attached (e.g., by adhesive) to the inside of the outer portion of the pressure container 160 and a panel 174 that is attached (e.g., by adhesive to the inside of the inner portion of the pressure container 160.

Panels 174 are typically spaced very close to each other around the inner portion of pressure container 160. Panels 172 are typically spaced farther apart from each other around the outer portion of pressure container so as to accommodate the increased spacing that occurs as the outer portion of the pressure container travels around the rotatable assemblies.

Coupled between each outer panel 172 and inner panel 174 are guide assemblies 176 (typically two for each pair of inner and outer panels). In the illustrated implementation, guide assemblies 176 include a first guide 177 that is hingedly coupled to outer panel 172 at a first end and a second guide 178 that is hingedly coupled to inner panel 174 at a first end. The guides 177, 178 are hingedly coupled to each other at their second ends. The guides alternate between an expand position in which they give structure and shape to pressure container 160 and a contracted position in which they allow pressure container 160 to collapse.

Panels 172, 174 typically have a flat outer surface where they attach to the pressure container 160. In some implementations, the opposite surface (i.e., the one facing the inside of the pressure container) may also be flat. In the illustrated implementation, the opposite surfaces have channels 175 in them for receiving the guides 176, 177 when they collapse. Panels 172,174 may, for example, be made of metal (e.g., steel).

Motor 100 also includes panels 180, which are on the outside of the inner portion of pressure container 160. Thus, the inner portion of pressure container 160—the portion that travels around rotatable assemblies 150—is sandwiched between inner panels 174 and panels 180. Panels 180 are typically flat on their inner and outer surfaces and are attached to pressure container 160 (e.g., by adhesion).

Motor 100 also includes a cam assembly 190. The cam assembly is configured to disengage the guide assemblies 170 from their expanded position. Cam assembly 190 may, for example, be composed of wheels or slider blocks.

FIGS. 5A-5C illustrate an example cam assembly 190'. Can assembly 190' includes two slider blocks 191, 192, one on either side of a guide assembly 170. Pressure container 160, which surrounds guide assembly 170 is not shown for the sake of clarity.

As the guide assembly 170 approaches the cam assembly 190, the slider blocks 191, 192 engage the guides 176, 177 at their second ends. As the guide assembly proceeds to move past the slider blocks, the slider blocks force the second ends of the guides to move inward. As the guide assembly moves past the slider blocks, the second ends of the guides are collapsed inwards. The guide assembly may continue to collapse further after departing from the slider blocks (e.g., due to weight and/or liquid pressure).

Motor 100 also includes rotatable assemblies 240. Rotatable assemblies 240 include multiple wheels 242 mounted so that they contact the outside of the pressure container 160.

Positioned in the bottom of pressure container 160 is a heavy body 195. In particular implementations, heavy body 195 may be a very dense liquid (e.g., mercury) or a physical object (e.g., a lead roller). Heavy body 195 is adapted to cause collapsed guide assemblies to expand. If a high density liquid is used, the liquid may be +/− to the height of the power axis.

Figure 2:
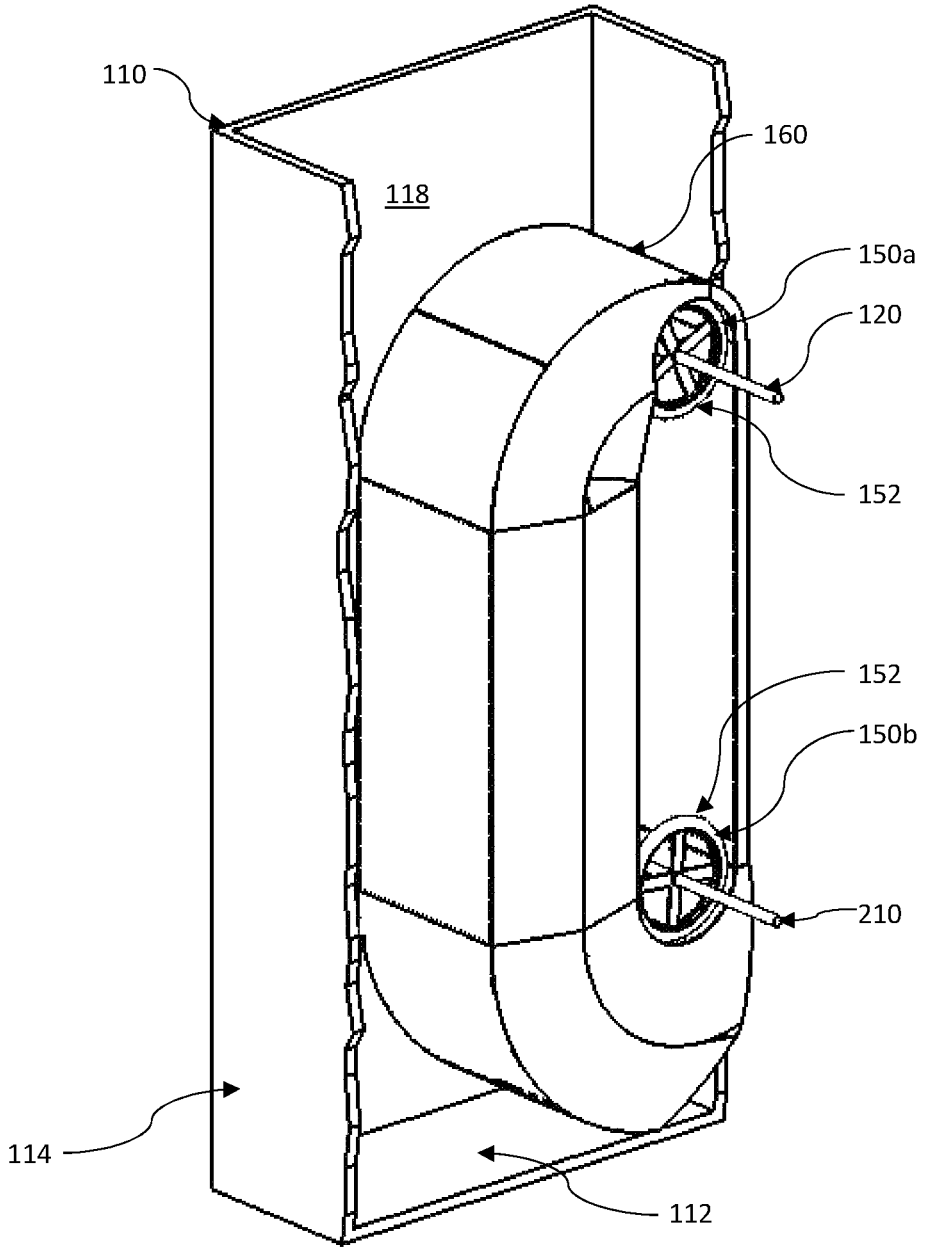
FIG. 2 is a cut-away perspective view illustrating the example motor in FIG. 1.
Figure 3:
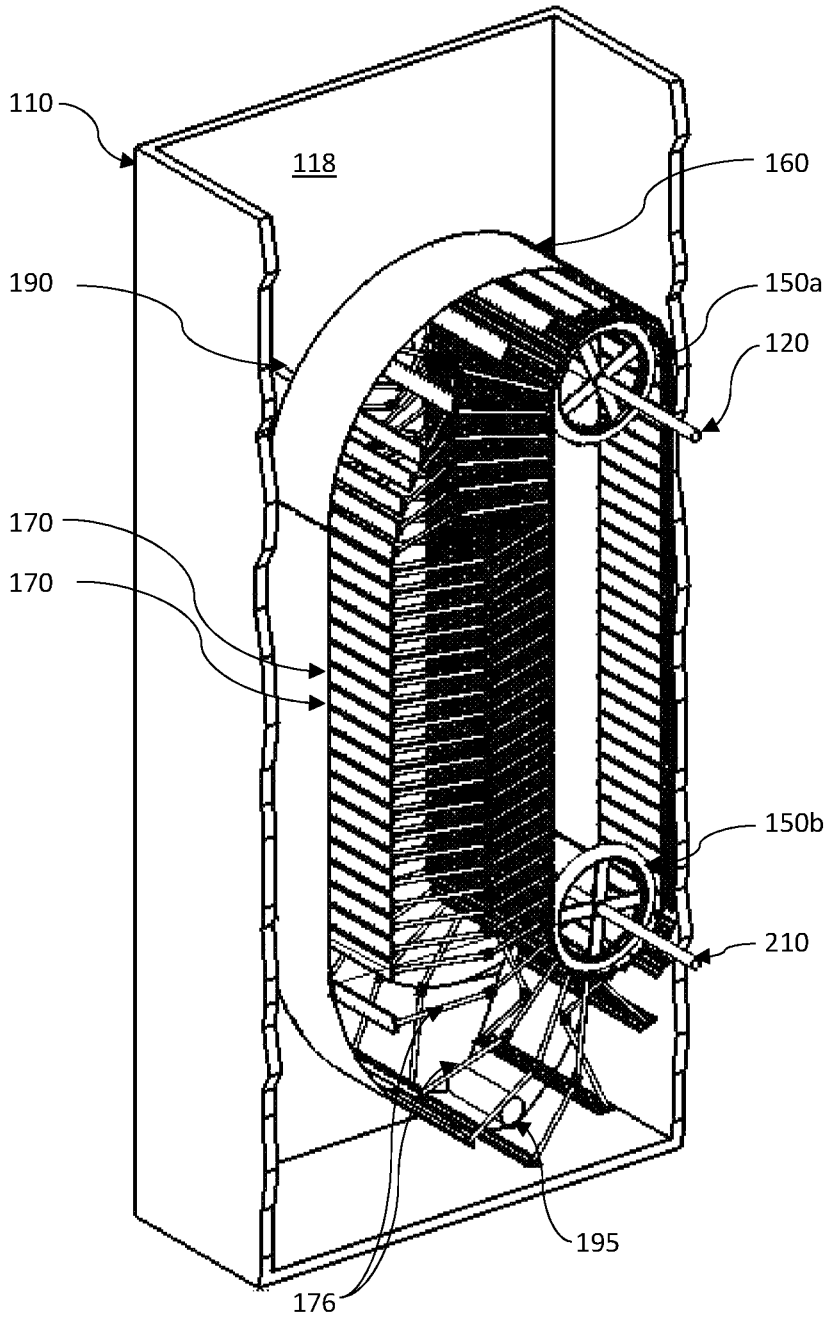
FIG. 3 is a further cut-away perspective view illustrating the inner workings of the example motor in FIG. 1.
Figure 3B:
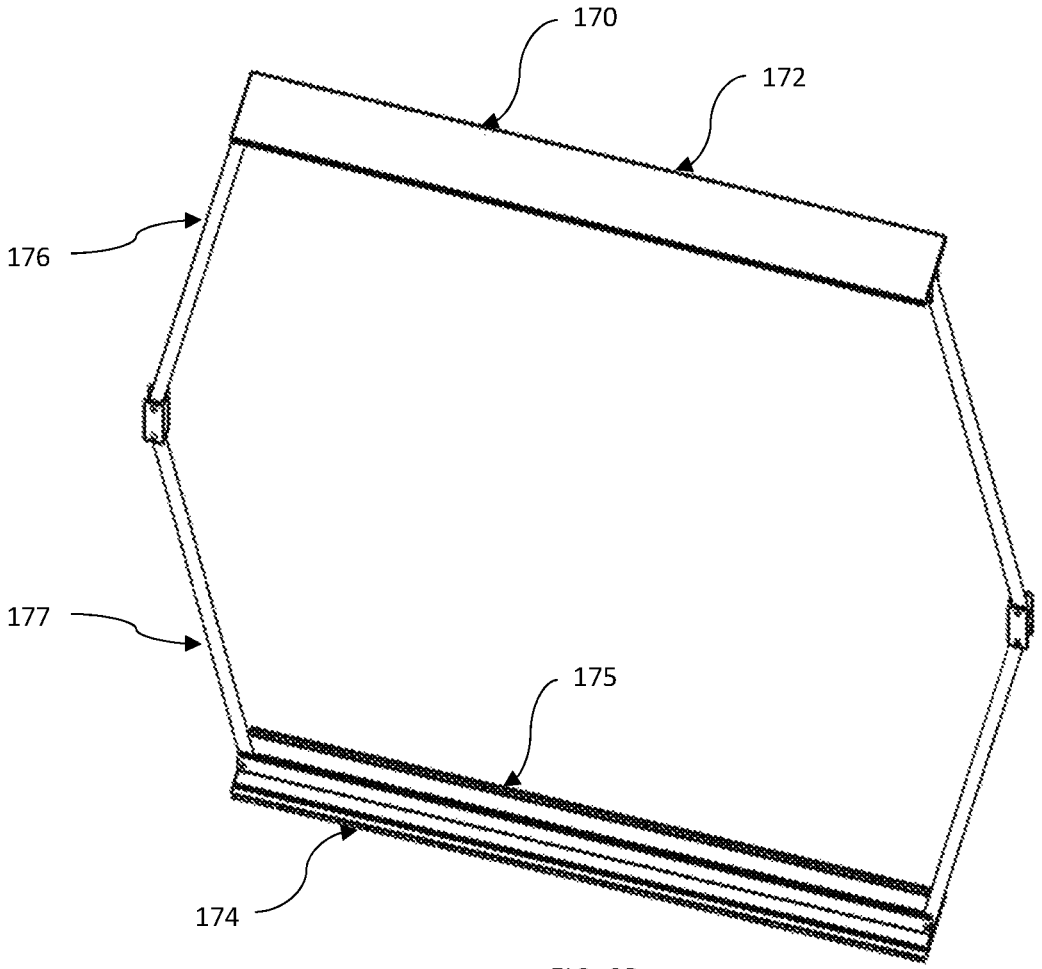
FIG. 3B is a perspective view of a guide assembly for the example motor in FIG. 1
Figure 4:
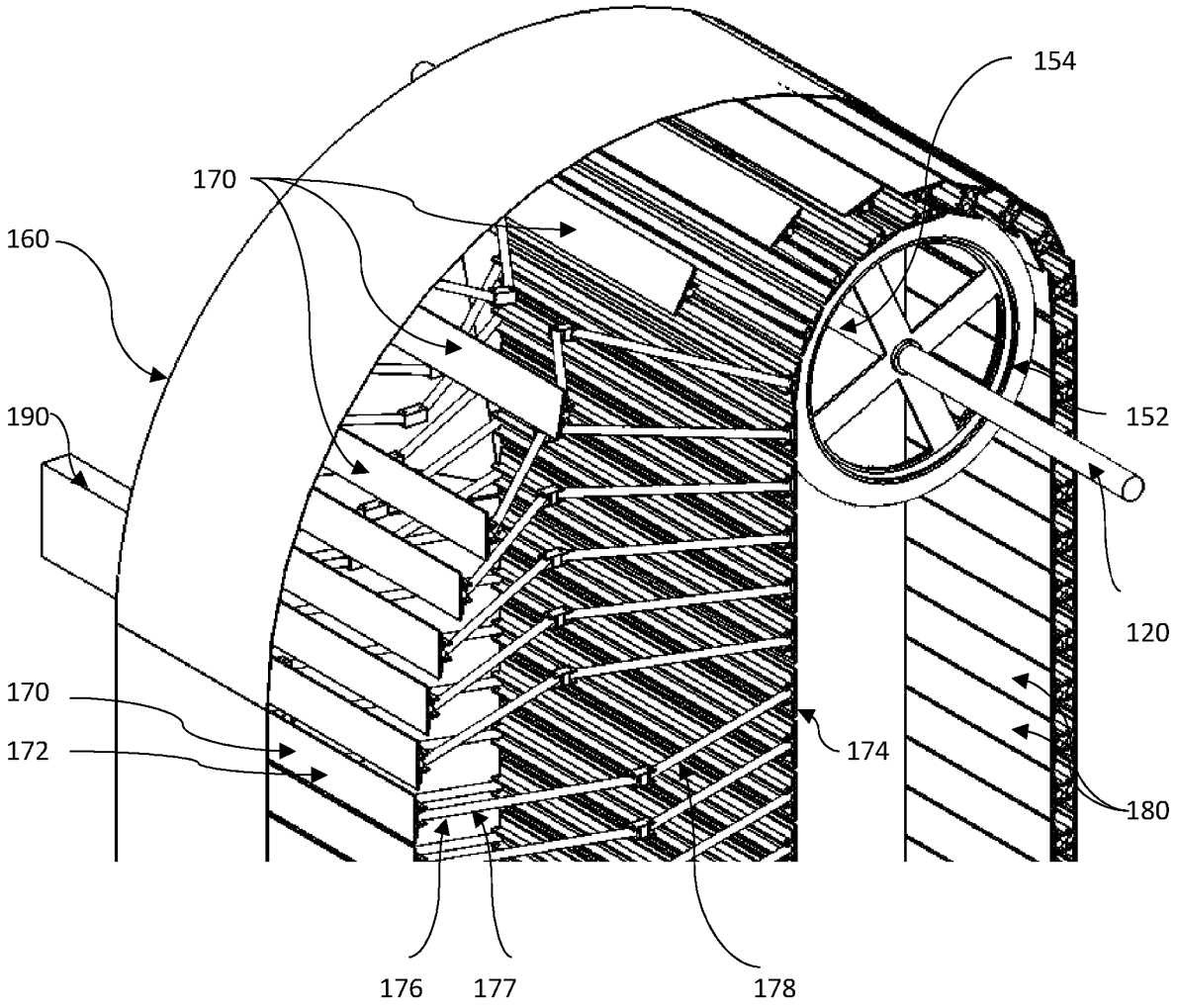
FIG. 4 is a cut-away detailed perspective view of the example motor in FIG. 1 with the housing removed.
Figure 4B:
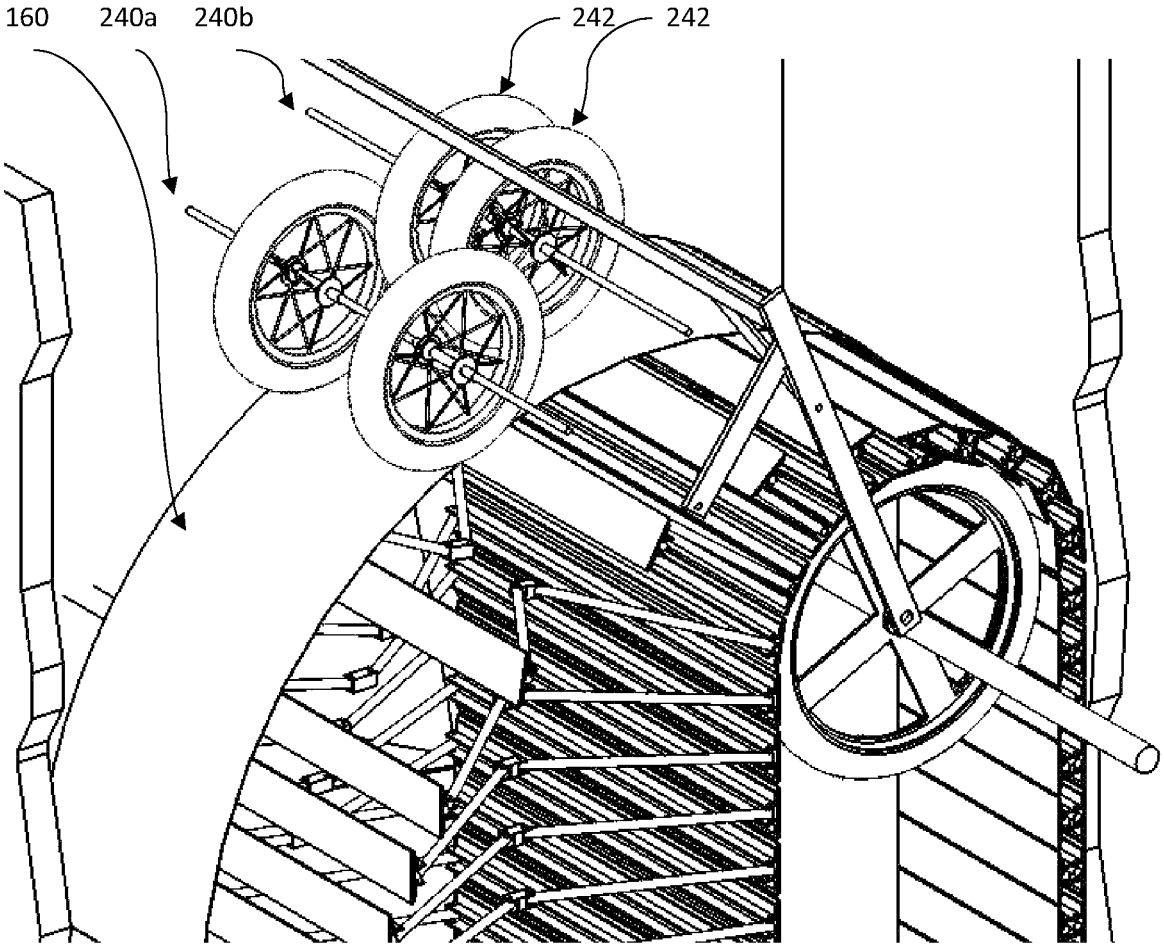
FIG. 4B is another cut-away detailed perpsective view of the example motor in FIG. 1.

As best shown in FIG. 2, when the pressure container 160 is expanded, it is offset in the liquid in chamber 118, due to one portion of the pressure container being expanded and the another portion being collapsed. The expanded portion of the pressure container 160 will be urged to move upwards (in a clockwise motion in FIG. 2) due to the buoyancy of that portion and rotate the whole pressure container 160 around rotatable assemblies 150. During this motion, the lower part of the pressure container that is collapsed will advance in a rotary movement around rotatable assembly 150*b* to a point where heavy body 195 activates the guide assemblies 176 of the collapsed press assemblies 170 so that they are placed in an expanded position, which allows the passage of fluid going from the collapsing portion of the pressure container to the expanding portion of the pressure container. In particular implementations, the volume of the expanding portion is approximately equal to the volume of the contracting portion. Thus, the fluid pressure in pressure container 160 remains relatively constant. In the illustrated implementation, expanded guide assemblies 170 are bowed outward slightly, which helps to lock them into place.

The expanded guide assemblies 170 will stay expanded as they move toward rotatable assembly 150*a,* resisting the pressure due to the liquid in chamber 118 and keeping the volume in the pressure container constant. When the expanded guide assemblies 170 encounter cam assembly 190, the guides 176, 177 will be biased toward the inside of the pressure container, which will allow the guide assemblies, and hence the pressure container, to start collapsing. At the beginning, the collapsing will occur due to the weight of the collapsing guide assembly and the liquid on the pressure container. As the collapsing portion of the pressure container moves further, it will encounter rotatable assemblies 240, which will further collapse the collapsing portion of the pressure container. When traveling toward rotatable assembly 150*b,* the collapsed portion of the pressure container 160 will contain little if any fluid.

As the force applied to the bottom of the pressure container is continuous, the motion of the pressure container and, hence, the expansion/collapsing process, is continuous.

In particular implementations, motor 100 may start to move automatically once chamber 118 is filled with liquid. In some implementations, motor 100 may require assistance to begin moving. To start the movement, motor 100 has an inertia generator wheel 230, which can be activated manually or with some powered mechanism, such as a motor vehicle. The weight of this wheel may be approximately equivalent to a quarter of the weight of the chamber surrounding one cylinder if it were solid steel. The combination of the kinetic forces of buoyancy and inertia ensure continuity tending to win the buoyant force that is the greater force.

Motor 100 has a variety of features. For example, motor 100 may produce kinetic energy in a renewable manner without the consumption of fossil fuels. The kinetic energy may be used to perform useful mechanical work or generated electrical power.

FIG. 6 illustrates an alternate implementation of a motor 100'. Motor 100' is similar to motor 100 in that it includes rotatable assemblies 150 (only one of which is shown) around which a collapsible pressure continer 160 is looped. Motor 100', however, includes a series of locking assemblies 250 on the outside of pressure container 160. Locking assemblies 250 maintain pressure container in a collapsed state after it traverses rotatable assembly 150*a*.

Locking assemblies 250 includes plates 252 mounted on the outer periphery of pressure container and plates 254 mounted on the inner periphery of the pressure container. The plates may, for example, be made of metal or plastic. In particular implementations, the plates may be mounted opposite internal panels. Hingedly coupled to the outer plates 252 are arms 256. The arms are adapted to engage inner plates 254 (e.g., via a tang) when the pressure container is collapsed. A cam system similar to cam system 190 may be used to engage the arms with inner plates 254 at rotatable assembly 150*a* and to disengage the arms from the inner plates at the other rotatable assembly 150.

Motor 100' also include a cam assemblies 190" (only one of which is shown for clarity). As opposed to cam assembly 190', cam assemblies 190" include a rotatable wheel 196 that acts to disengage guide assemblies inside pressure container 160.

FIG. 7 illustrates a number of motors 100 coupled together in series through their drive shafts 120. Thus, the power of the motors may be linked with each other.

FIGS. 8-12 illustrate another example motor 300. Motor 300 includes a tank 310 that is adapted to hold a liquid 302 (e.g., water, mercury, etc.) and a drive section 320 that is adapted to produce power and/or energy from the kinetic energy of a moving body. In the example implementation, tank 310 is approximately 1.2 m×1.2 m×3 m, and drive section 320 is approximately 1 m×1 m×2.5 m. However, tank 310 and drive section 320 may be sized for the appropriate application.

Tank 310 forms a chamber 312 in which drive section 320 may be immersed in liquid 302. Tank 310 may, be made of concrete, plastic, or any other appropriate material. Although illustrated as being square in cross-section, tank 310 may have other cross-sectional shapes (e.g., rectangular, circular, oval, etc.). In the illustrated implementation, tank 300 includes flaps 410 to keep the liquid from swirling in the tank. In certain implementation, liquid 302 may include antioxidants and lubricity additives, which will facilitate proper operation.

Drive section 320 includes cylinders 322, the upper one mounted on a drive shaft 324 and the lower one mounted on a power shaft 326, which are adapted to rotate freely. The drive section, including cylinders 322, drive shaft 324, and power shaft 326, will be located inside tank 310, leaving the drive section in liquid 302. The drive shaft and the power shaft are rotatably mounted to the walls of the tank. 310 (e.g., by liquid proof bearings or bushings) and extend therethrough.

Wrapped around cylinders 322 (e.g., in a continuous loop) is a pressure container 390. Pressure container 390 is adapted to contain the fluid and is collapsible/expandable. Pressure container 390 may be made of rubber, synthetic rubber, vinyl, plastic, or any other appropriate material. In particular implementation, the pressure container may include a fabric-like material on the outside (e.g., woven nylon or polyester) to reduce wear.

Drive section 320 also includes panels 370, which are distributed equidistantly on the outer perimeter of the drive section, and tracks 380, one on each side of the drive section. Panels 370, which may, for example, be made of metal (e.g., aluminum or steel) or plastic, allow the expansion and collapse action of the pressure container under the direction of the tracks 380, which may, for example, be made of steel or plastic. The panels are coupled to the tracks by bearings 372.

To facilitate the sliding of the pressure container, backrest sides 340 are located on the inside perimeter of the pressure container between the cylinders, in order to reduce friction.

In operation, approximately one half of pressure container 390 will be expanded while the other half is collapsed. As the pressure container moves around the cylinders, the upper end of the expanded side will become collapsed while the lower end of the collapsed side will become expanded. This process is continuous. The expansion and collapse of the pressure container will be dictated by the movement of the pressure container with the panels, which are guided by, tracks 380.

When submerged, the expanded portion of the pressure container will tend to move up, moving the panels. The lower part of the pressure container that is collapsed by the panels 370 will move in a rotary motion under the guidance of where the bearings 372 of the panels, positioned by the tracks 380, gradually allowing the passage of fluid passing from the collapsing portion to the expanding portion. The fluid will flow back into the portion of the pressure container that is expanding at the lower end. In order that the pressure container does not expand to the sides, panels 370 confine the outer sides of the pressure container.

To start the movement, motor 300 includes an inertia generator wheel 430 coupled to power axis 410, which can be activated manually or with some mechanism, such as by a motor vehicle. The weight of this wheel may be approximately equivalent to a quarter of the weight of the area surrounding one cylinder if it were solid steel. The combination of the kinetic forces of buoyancy and inertia ensure continuity, tending to favor the buoyant force, which is the greater force.

The rotary power from drive shaft 320 may be used for performing mechanical work or for generating electricity. The electricity may be generated internal or external to the motor.

FIG. 13 illustrates another example motor 500. Similar to motor 1, motor 500 includes a tank 510 and a drive section 520. Drive section 520, however, includes one drive shaft 530 to which a cylinder 540 is mounted. Wrapped in a loop around cylinder 540 is a collapsible pressure container 550. The pressure container is guided by panels 560, which are guided by track 570.

In operation, the offset of pressure container 550 creates a bouyancy force that drives the pressure container around the cylinder 540 (i.e., in a counterclockwise direction). As a portion of the pressure container nears the cylinder, the portion is collapsed under the influence of presses 560, the fluid in the portion flowing back into the remaining expanded portion. The portion then travels around the cylinder in a collapsed state. As a collapsed portion of the pressure container leaves the cylinder, the fluid in the pressure container fills the portion.

FIGS. 14-16 illustrate an additional example motor 600. Motor 600 includes a tank 610 filled with a liquid 630 (e.g., water) divided in half by a divider 620.

On one side of the divider 620, bubbles of some gas (e.g., air or nitrogen) will be introduced to the water in order to decrease its density. A rotatable shaft 650 with air filled pressure containers 660 coupled thereto is located in the water. The pressure containers may be made of plastic, rubber, or any other appropriate material. The pressure containers may, for example, be commercial motor vehicle tires. To contain the bubbles on one side of the tank, a netting may be used around the holes in divider 620. The netting may, for example, have the density of mosquito netting.

One half each chamber will be on the side of the tank with low density liquid (i.e., with air bubbles), and the other half will be on the side of the tank with normal density liquid. The difference in the density of the water on the two sides generates an imbalance. Thus, the side that is in the normal density liquid will tend to float more than the side that is in the low density liquid, which will cause the pressure containers 660 to rotate.

The rotation of the pressure containers causes the rotatable shaft 650 to rotate. Coupled to the rotatable shaft is a power axis 700. The power axis may drive a generator and/or a mechanical device.

Motor 600 also includes a pump 670 that draws water from the tank 610 through a conduit 680. In particular implementations, conduit 680 may be placed in a remote part of the tank to acquire water that has a low bubble content. The pumped water is then fed to venturis 710 through a conduit 720. The venturis are also fed with gas through a conduit 730 so that the water that is injected contains gas bubbles, which creates the low density water.

The terms "about" or "approximately" are defined as being "close to" as understood by one of ordinary skill in the art, and in one non-limiting embodiment, the terms are defined to be within 10%, preferably within 5%, more preferably within 1%, and most preferably within 0.5%. Accordingly, unless indicated to the contrary, the numerical parameters set forth in this specification and attached claims are approximations that may vary depending upon the desired properties sought to be obtained by the exemplary embodiments described herein. At the very least, and not as an attempt to limit the application of the doctrine of equivalents to the scope of the claim, each numerical parameter should at least be construed in light of the number of reported significant digits and by applying ordinary rounding techniques.

The term "substantially" and its variations are defined as being largely but not necessarily wholly what is specified as understood by one of ordinary skill in the art, and in one non-limiting embodiment, substantially refers to ranges within 10%, within 5%, within 1%, or within 0.5%.

The term "effective," as that term is used in the specification and/or claims, means adequate to accomplish a desired, expected, or intended result.

The terms "a" or "an" when used in conjunction with the term "comprising" in the claims and/or the specification may mean "one," but it is also consistent with the meaning of "one or more," "at least one," and "one or more than one."

The term "each" refers to each member of a set or each member of a subset of a set.

The terms "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

In interpreting the claims appended hereto, it is not intended that any of the appended claims or claim elements invoke 35 U.S.C. 112(f) unless the words "means for" or "step for" are explicitly used in the particular claim.

The invention has been explicitly described with a variety implementations, and many other have been mentioned or suggested. Additionally, those of ordinary skill in the art will readily recognize that a variety of additions, deletions, substitutions, and modifications may be made while still achieving a motor powered by continuous flotation. Thus, the scope of protected subject matter should be judged based on the append claims, which many encompass one or more concepts of one or more implementations.

The invention claimed is:

1. A power generation system, the system comprising:
- a tank adapted to hold a liquid; and
- a drive section submersed in the tank, the drive section comprising:
  - a continuous, collapsible pressure container;
  - a rotatable assembly around which the pressure container is routed, the rotatable assembly comprising a drive shaft rotatably mounted to the tank; and
  - a series of panels guided around the rotatable assembly to encourage the pressure container to expand and collapse as it circulates around the rotatable assembly.

2. The system of claim 1, further comprising a second rotatable assembly around which the pressure container is also wrapped, the second rotatable assembly comprising a drive shaft rotatably mounted to the tank.

3. The system of claim 1, wherein the first rotatable assembly and the second rotatable assembly are vertically aligned with each other and horizontally aligned.

4. The system of claim 2, wherein the drive shaft of the second rotatable assembly contains an inertia wheel for starting the motor.

5. The system of claim 2, further comprising a panel between the rotatable assemblies along which the inner periphery of the pressure container may slide.

6. The system of claim 1, wherein the liquid comprises water.

7. The system of claim 1, wherein the panels are mounted inside the pressure container.

8. The system of claim 7, wherein the panels comprise one set of panels mounted on the inside of an inner periphery of pressure container and a second set of panels mounted on the inside of an outer periphery of the pressure container.

9. The system of claim 8, wherein the inner and outer panels are paired and the panels in each pair are connected to each other by a guide assembly.

10. The system of claim 9, further comprising a cam assembly to collapse the guide assemblies.

11. The system of claim 1, wherein the panels are mounted to the outside of the pressure container.

12. The system of claim 11, further comprising a track to guide the panels around the rotatable assembly.

13. The system of claim 1, further comprising a locking assembly comprising a hingedly attached arm configured to lock an outer portion of the pressure container to an inner portion of the pressure container when the pressure container is collapsed.

14. A power generation system, the system comprising:
- an elongated tank adapted to hold a liquid;
- a first rotatable assembly comprising a drive shaft rotatably mounted horizontally in the tank;
- a second rotatable assembly comprising a drive shaft rotatably mounted horizontally in the tank, the second rotatable assembly spaced apart vertically from the first rotatable assembly;
- an elongated, inflatable/collapsible, continuous pressure container routed around the rotatable assemblies; and
- a series of panels mounted to the inside of an outer portion of the pressure container, the panels urging the expansion and collapse of the pressure container as it circulates around the rotatable assemblies.

15. The system of claim 14, further comprising:
- a series of panels mounted to the inside of an inner portion of the pressure container, the inner panels and the outer panels being paired; and
- a guide assembly between each pair of inner panel and outer panels.

16. The system of claim 14, further comprising a locking assembly comprising a hingedly attached arm configured to lock an outer portion of the pressure container to an inner portion of the pressure container when the pressure container is collapsed.

* * * * *